US011192747B1

(12) United States Patent
Murphy, Jr.

(10) Patent No.: US 11,192,747 B1
(45) Date of Patent: Dec. 7, 2021

(54) FLEXIBLE CONDUIT DISPENSER CASE

(71) Applicant: Michael R. Murphy, Jr., Burlington, IL (US)

(72) Inventor: Michael R. Murphy, Jr., Burlington, IL (US)

( * ) Notice: Subject to any disclaimer, the term of this patent is extended or adjusted under 35 U.S.C. 154(b) by 337 days.

(21) Appl. No.: 16/393,245

(22) Filed: Apr. 24, 2019

(51) Int. Cl.
*B65H 51/32* (2006.01)
*B65H 49/20* (2006.01)

(52) U.S. Cl.
CPC ..... *B65H 51/32* (2013.01); *B65H 49/205* (2013.01)

(58) Field of Classification Search
CPC ..... B65H 51/32; B65H 49/205
See application file for complete search history.

(56) References Cited

U.S. PATENT DOCUMENTS 3,612,424 A * 10/1971 Friedel ..... G03B 27/588 242/348.4
4,088,276 A * 5/1978 Littleton ..... B65H 16/005 225/46
2003/0085317 A1* 5/2003 Martin ..... B65H 49/205 242/588.1
2012/0091249 A1* 4/2012 Crossett ..... B65D 85/04 242/580
2013/0140396 A1* 6/2013 Gupta ..... B65H 59/06 242/416
2015/0265037 A1* 9/2015 Foreman ..... B65H 49/205 224/665
2015/0298935 A1* 10/2015 Langeman ..... B65H 75/10 242/588

* cited by examiner

*Primary Examiner* — Sang K Kim
(74) *Attorney, Agent, or Firm* — Brie A. Crawford; Crawford Intellectual Property Law LLC

(57) ABSTRACT

A flexible conduit dispenser case is disclosed. An outer body defines an inner chamber where flexible conduit can be coiled. The flexible conduit is coiled around a rotating hub, which makes the flexible conduit easier to dispense. The flexible conduit dispenser case can be locked to help to retain the flexible conduit. The flexible conduit emerges from an exit port on the handle of the flexible conduit dispenser case for ease of access and control. Also disclosed is a planar base which holds the flexible conduit dispenser case in position for increased ease of dispensing the flexible conduit and engagement members on the rotating hub increase the retention of the flexible conduit.

18 Claims, 9 Drawing Sheets

FLEXIBLE CONDUIT DISPENSER CASE

This invention relates to a dispenser case for flexible conduit. Flexible conduit is stored in a case which provides portability and protection and keeps the conduit organized. An internal configuration allows the conduit to be easily dispensed as needed for use. A method for using the same is also disclosed.

BACKGROUND OF THE INVENTION

The present invention relates to a dispenser case for flexible conduit. Flexible conduit, which is usually metallic, is used in many electrical system installations. It allows electrical cable to be retained in conduit while passing through turns or constrained areas in which rigid conduit cannot be easily or efficiently installed.

Flexible conduit is usually sold in coils, and transported to the job site and cut to length as needed. While this is known to persons of ordinary skill in the art, there are multiple issues related to flexible conduit that make it difficult and inefficient to store, transport, and use.

First, flexible conduit is very unwieldy. When cut free from the coils it is distributed in, it tries to extend itself due to the elasticity of the material. A dispenser case which can keep flexible conduit in good order is a useful invention.

Second, flexible conduit is very susceptible to crushing or bending damage. Flexible conduit is made by wrapping a long, thin strip of appropriate material, usually metal, in a spiral fashion around a form to form a flexible hollow tube. If the tube is bent too sharply, it can kink or separate. If it is crushed, the thin metal strip is easily deformed and can separate. A dispenser case which protects flexible conduit from crushing and bending damage in transit and in use is a useful invention.

Third, flexible conduit is unwieldy in use. It is very springy and will assume awkward shapes unless constantly held in position. Getting a desired length laid out and cut, while not damaging or disordering the remainder of the coil, is inefficient and time consuming. A dispenser case which makes it easier and more efficient to dispense a desired quantity of flexible conduit is a useful invention.

Fourth, flexible conduit stored in a coil will bind if pulled out of the coil in a rotary motion, even if there is a central hub element to keep the coil from completely collapsing into a central circle. A dispenser case which prevents flexible conduit from binding as it is dispensed from a coiled configuration is a useful invention.

The present invention addresses these concerns.

SUMMARY OF THE INVENTION

Among the many objectives of the present invention is the provision of a dispenser case for flexible conduit.

Another objective of the present invention is the provision of a dispenser case for flexible conduit which allows the flexible conduit to be stored in a compact coiled configuration without damaging it or allowing it to tangle.

Yet another objective of the present invention is the provision of a dispenser case for flexible conduit that allows for easy one-handed operation and control.

Still another objective of the present invention is the provision of a dispenser case for flexible conduit which allows flexible conduit to be dispensed while in its coiled form without binding or snarling as it is dispensed.

A still further objective of the present invention is the provision of a method for using a dispenser case for flexible conduit.

Other objectives and advantages of the present invention will become apparent to those of ordinary skill in the art upon review of the disclosure herein.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

Figure 1:
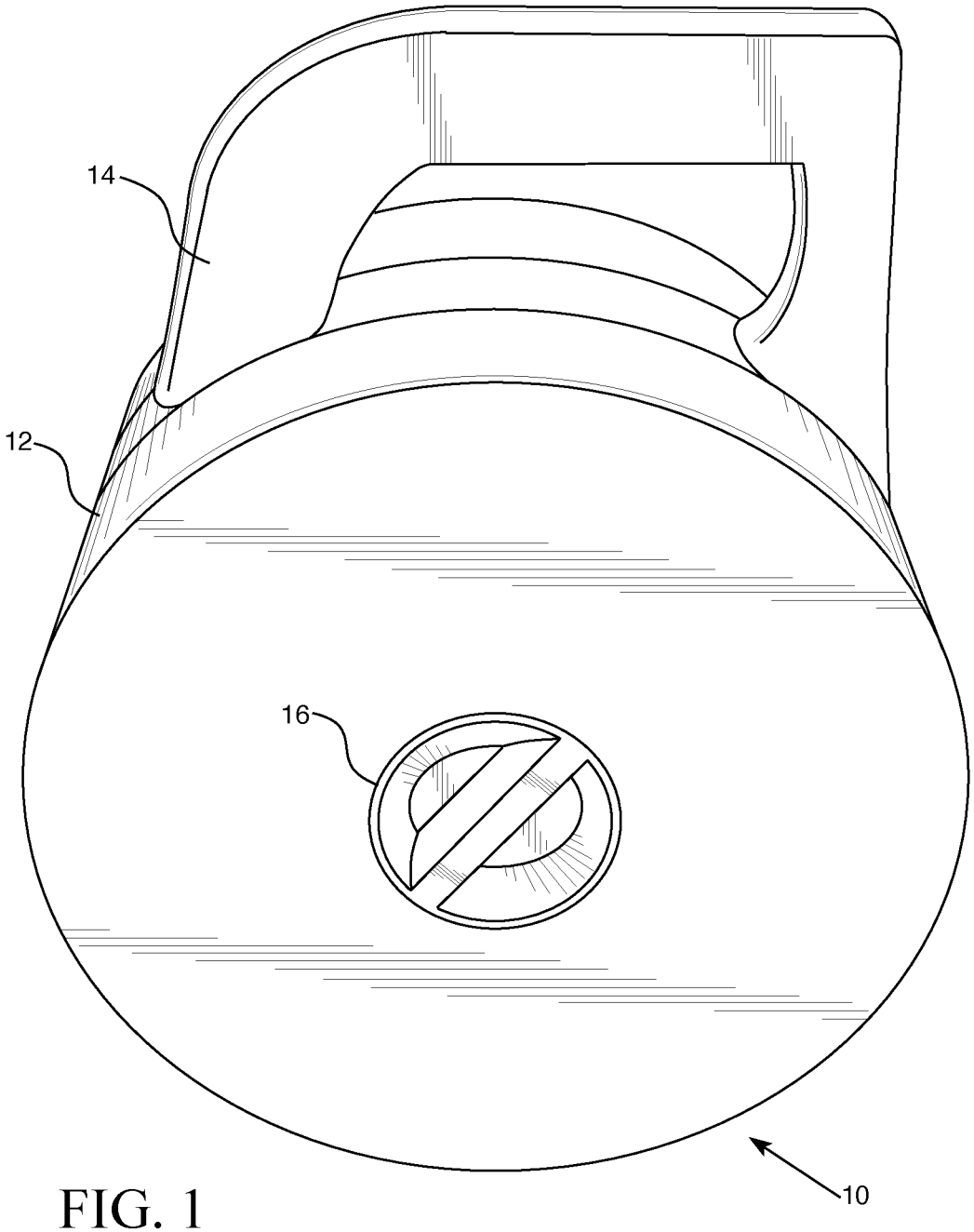
FIG. 1 depicts a right perspective view of the flexible conduit dispensing case 10.
Figure 2:
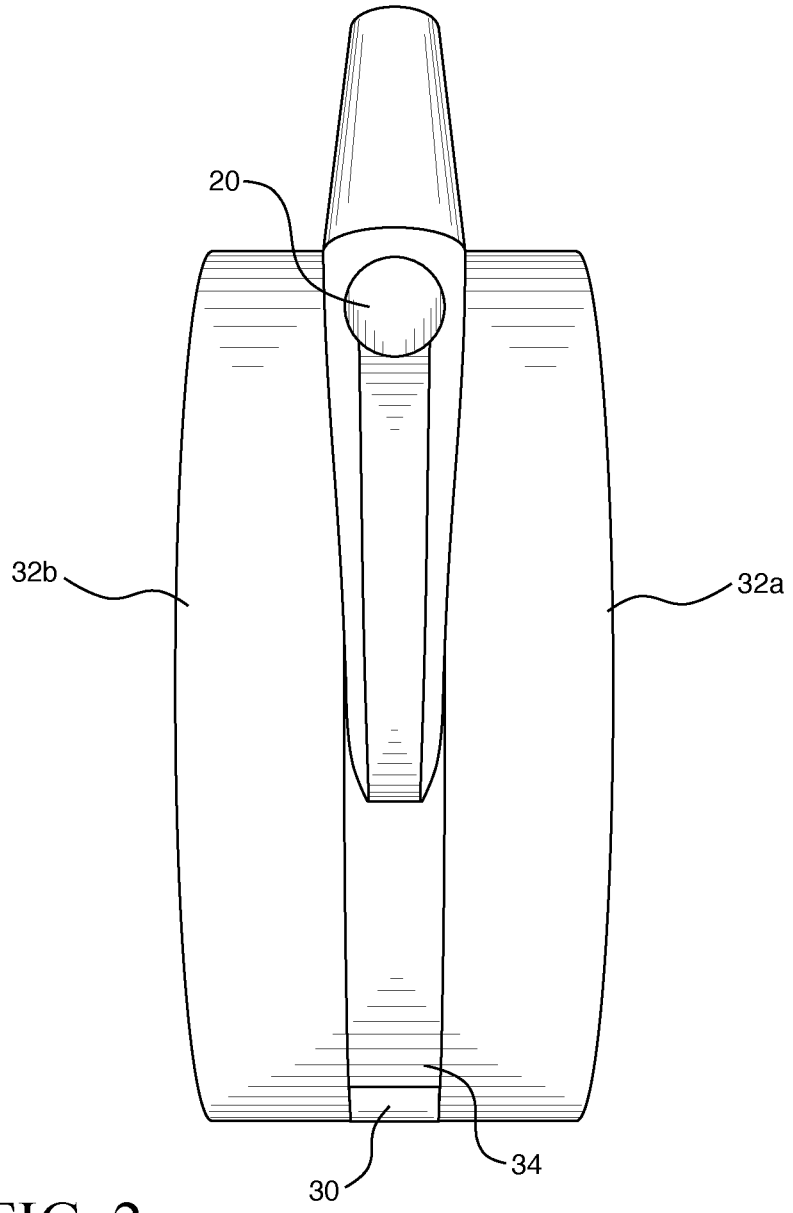
FIG. 2 depicts a front elevational view of the flexible conduit dispensing case 10.
Figure 3:
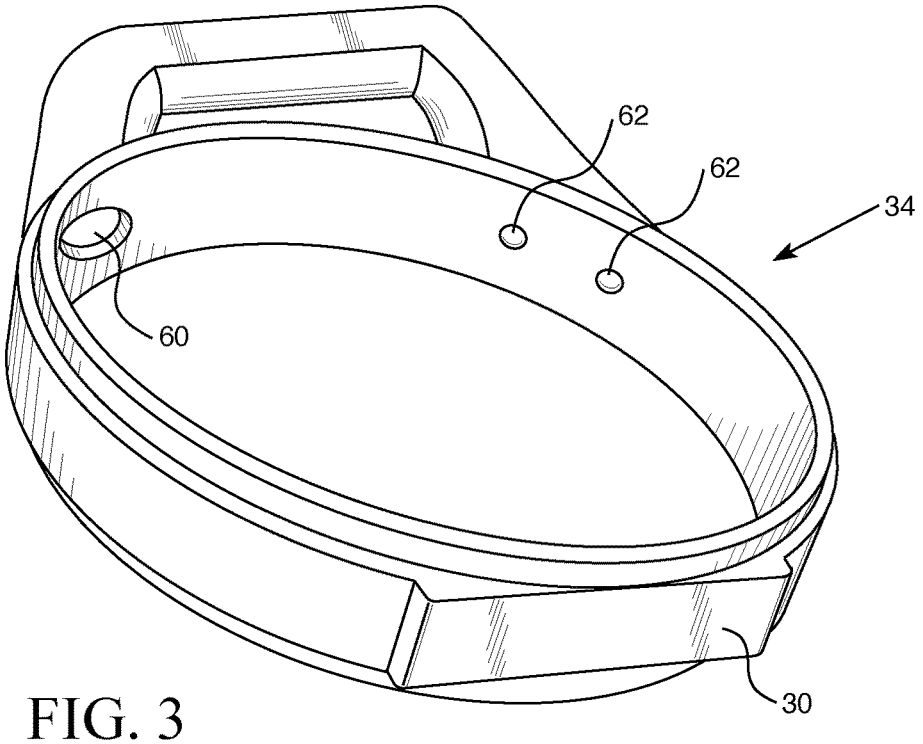
FIG. 3 depicts a right perspective view of the joining ring 34 of flexible conduit dispensing case 10.
Figure 4:
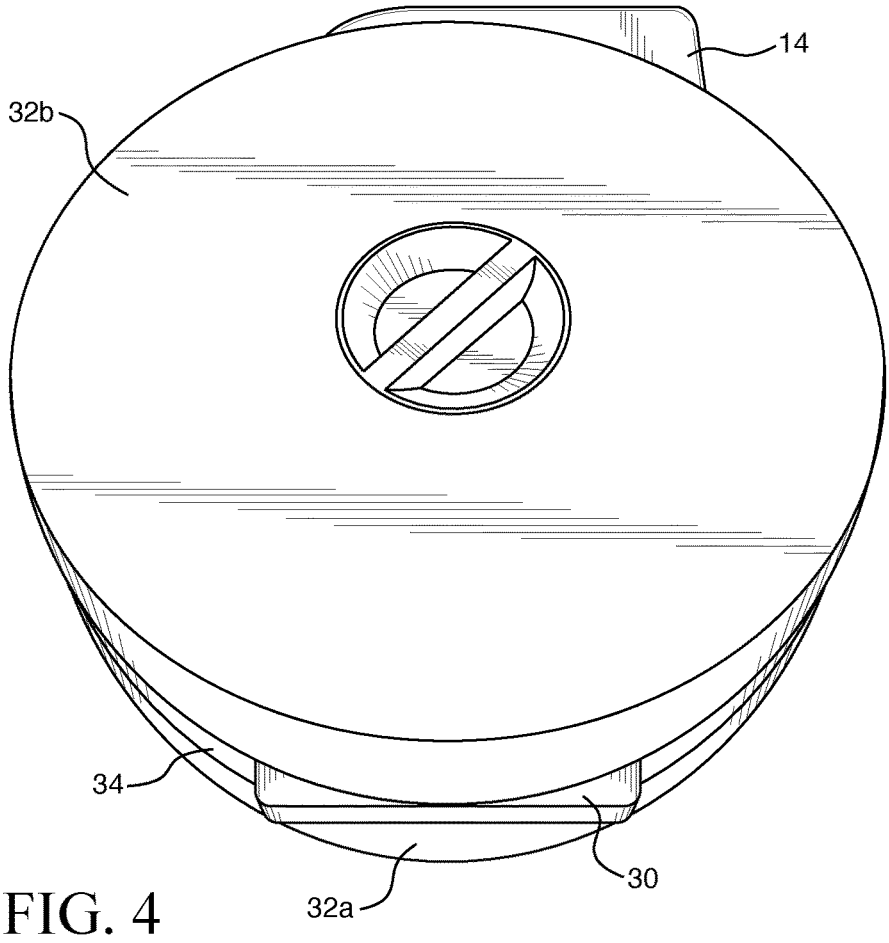
FIG. 4 depicts a right perspective view of the flexible conduit dispensing case 10 and showing planar base 30.

Reference will now be made in detail to several embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, can be used with respect to the drawings. These and similar directional terms are not to be construed to limit the scope of the invention in any manner. The words attach, connect, couple, and similar terms with their inflectional morphemes do not necessarily denote direct or intermediate connections, but can also include connections through mediate elements or devices.

The present invention relates to a dispenser case for flexible conduit. Flexible conduit is used in electrical wiring installations to allow electrical wiring to pass through conduit even in configurations where standard rigid conduit will not serve. It is made by winding a thin piece of metal around a form to create a flexible tube which provides protection and grounding features similar to those of standard rigid conduit. Because of the method of its manufacture, it is easily deformed (the contact points of the metal strip are not welded or otherwise sealed other than through mechanical pressure).

Flexible conduit is also very unwieldy in any quantity, as when it is coiled, it becomes tensioned and will uncoil if not restrained. Further, because of the elasticity of the flexible conduit and its tendency to engage itself when in contact with itself, if it is pulled out of a coil in a direction tangential to the coil's overall diameter, it will quickly bind or snarl and prevent the flexible conduit from being further extracted and possibly damaging it. If it is pulled out of the coil in a direction orthogonal to the coil's overall diameter, the coil will quickly pull itself apart.

If constrained, the fact that the flexible conduit is being pulled against a dispensing slot or port at an angle will also cause the flexible conduit to kink, bind, and/or be damaged. It is desirable that a dispenser case for flexible conduit allow the flexible conduit to be dispensed in a manner that is not likely to cause the flexible conduit to kink, bend, snarl, or be damaged.

By referring to FIGS. 1, 2, 3, 4, and 5 the basic principles of the invention can be clearly understood. Flexible conduit dispenser case 10 comprises outer body 12 and handle 14. Outer body 12 is formed by right side 32*b*, left side 32*a*, and joining ring 34. Joining ring 34 is between right side 32*b* and left side 32*a* and forms the center portion of outer body 12. Handle 14 is attached to joining ring 34 through any suitable fashion such as welding, manufacture as a unitary piece, or through the cooperation of fasteners with apertures 62 and all suitable methods are encompassed by this disclosure.

Locking member 16 engages key slot 74 of hub member 70 and removably affixes the left side 32*a* to the right side 32*b* with the joining ring 34 between sides 32*a* and 32*b* and allowing outer body 12 to be opened to add or remove flexible conduit 52 as a unitary coil and then to be locked together for use. Flexible conduit 52 is coiled around rotating hub 40 inside chamber 72 defined by outer body 12. Handle 14 has a conduit channel 18 which communicates with the chamber 72 where the flexible conduit 52 is stored and ends in exit port 20. The flexible conduit 52 can emerge only through exit port 20.

Since the conduit channel 18 is in the handle 14, the point at and direction in which the flexible conduit 52 emerges can be easily and efficiently controlled by a user (not shown) who is holding handle 14. The flexible conduit 52 is restrained from uncoiling or moving under tension and can easily be dispensed with one hand, leaving the other hand free for placing the conduit 52, cutting it, or any other desired operation. It is preferred that the conduit channel 18 be large enough, and its curve gradual enough, that flexible conduit 52 will move through handle 14 smoothly and with a reasonable minimum of friction. It is preferred that the conduit channel 18 have an extremely smooth and durable surface to maximize operational lifetime and minimize friction and potential damage to the flexible conduit 52.

Joining ring 34 has an opening 60 to allow the flexible conduit 52 to go from the chamber 72 into the handle 14. Planar base 30 is part of joining ring 34 and when the dispenser case 10 is set upright on planar base 30 (as in FIG. 5) handle 14, which is diametrically opposed to planar base 30, is in the uppermost possible position and is held steady and with minimal inclination to tilt. When flexible conduit 52 is pulled out of exit port 20, any rotational force which may be exerted is prevented from rotating the dispenser case 10 by planar base 30 even if not all of such force is reduced by rotating hub 40 and the low-frictional nature of the conduit channel 18.

Planar base 30 is diametrically opposed from the location of handle 14 and the planar base attaches at a perpendicular angle to the outer body 12. Note that it is strongly preferred that the handle 14 be diametrically opposed from the planar base 30 for maximum ease of operation. It is strongly preferred that the relative orientation of planar base 30, and handle 14 with exit port 20, be such that when the dispensing case is standing on the floor supported by the planar base 30, exit port 20 is in a horizontal orientation such that flexible conduit 52 emerges parallel to the floor. This minimizes kinking, bending, and crushing and provides for easy and efficient dispensing of flexible conduit 52.

When rotating hub 40 rotates in the center of the dispenser case 10 on hub member 70, engagement members 44 engage the exterior ridges of the flexible conduit 52 and keep the rotation smooth and even. Engagement members 44 also allow flexible conduit 52 to be more smoothly loaded into the case 10 as the engagement will ensure rotating hub 40 rotates smoothly and consistently and reduces the chance for tangles. While rotating hub 40 can be configured in any suitable fashion, it is preferred that it have some form of engagement members 44 which will cause rotating hub 40 to engage with the entire coil of flexible conduit 52 along its diameter so that when rotating hub 40 rotates, the entire coil 52 will rotate as a unit with the same rotational speed as rotating hub 40. This greatly reduces the occurrence of tangling, binding, and kinking which can occur if the entire coil did not move and the conduit 52 may form a spiral of a much smaller diameter than the general diameter of the coil 52 or form a kink or non-symmetric curve.

Figure 6A:
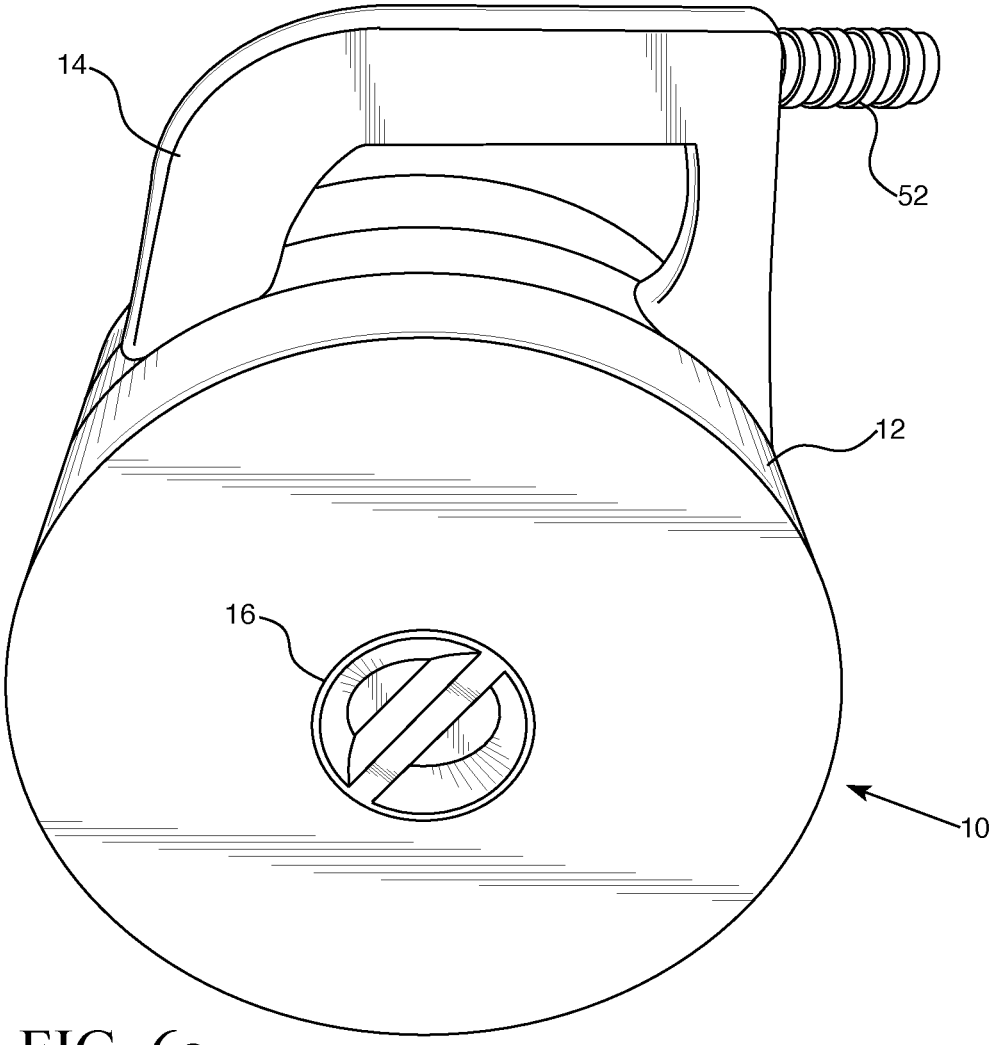
FIGS. 6*a* and 6*b* depict a right perspective view of the flexible conduit dispensing case 10 in use with flexible conduit 52.
Figure 6B:
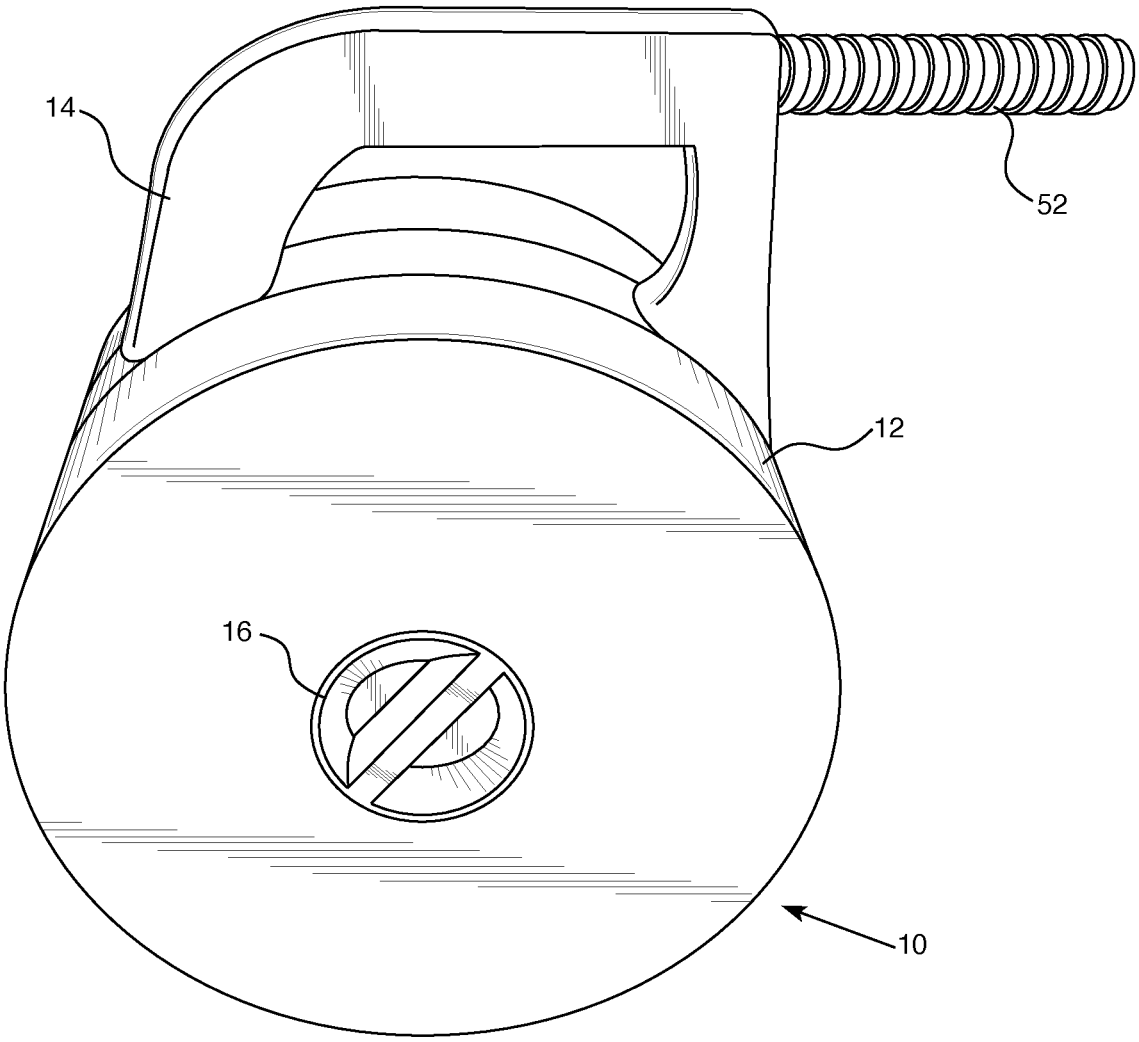

Now adding FIGS. 6*a* and 6*b* to the consideration, the operation of the invention can be seen. In FIG. 6*a*, a small length of flexible conduit 52 has been dispensed from the dispenser case 10 through exit port 20. In FIG. 6+b, more flexible conduit 52 has been dispensed. The conduit 52 can be placed as it emerges, or a predetermined length can be pulled out. Once in place, or once the desired length has been dispensed, the conduit 52 is cut and installed as per normal and customary usage in electrical installations.

Figure 7:
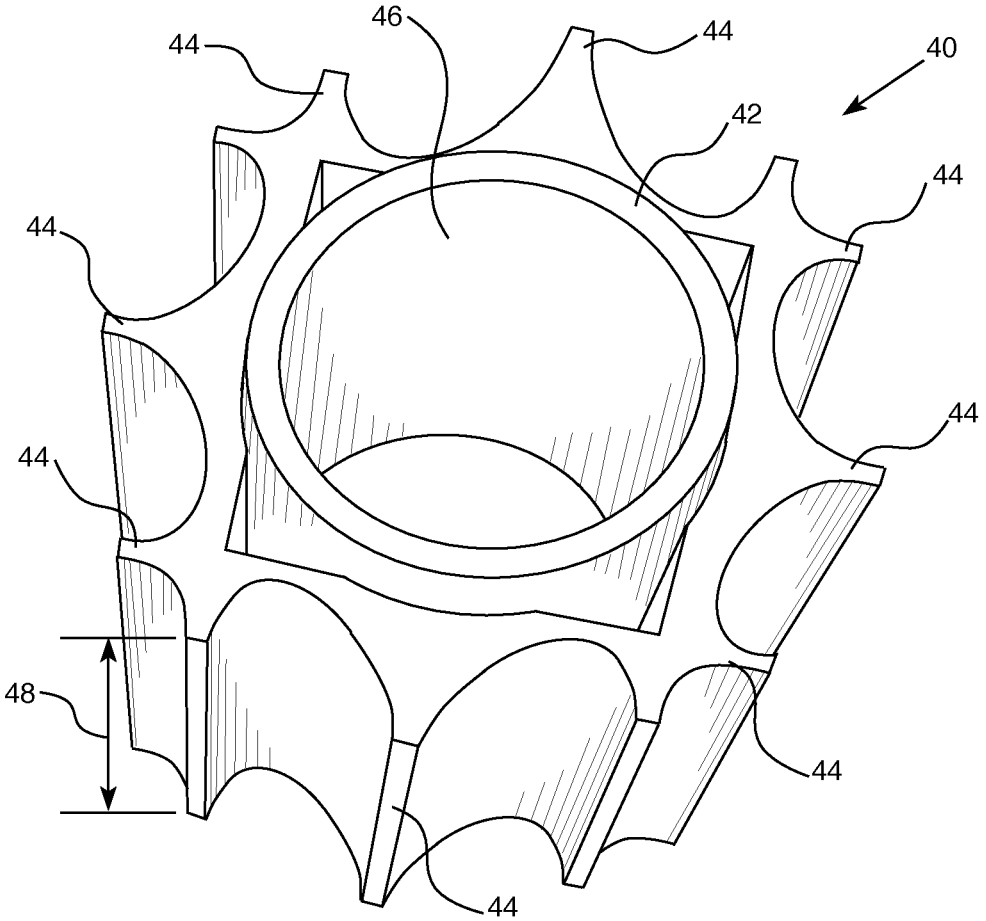
FIG. 7 depicts a perspective view of rotating hub 40.

FIG. 7 shows rotating hub 40 in isolation. Rotating hub 40 has a plurality of engagement members 44. Rotating hub 40 also has bearing ring 42, which can be an integral part (as shown) or a separate part which is fastened to the rest of the rotating hub 40 (not shown). If bearing ring 42 is a separate piece, it allows for repair or replacement of the bearing surface 46, or adapters for different size cases.

Figure 5:
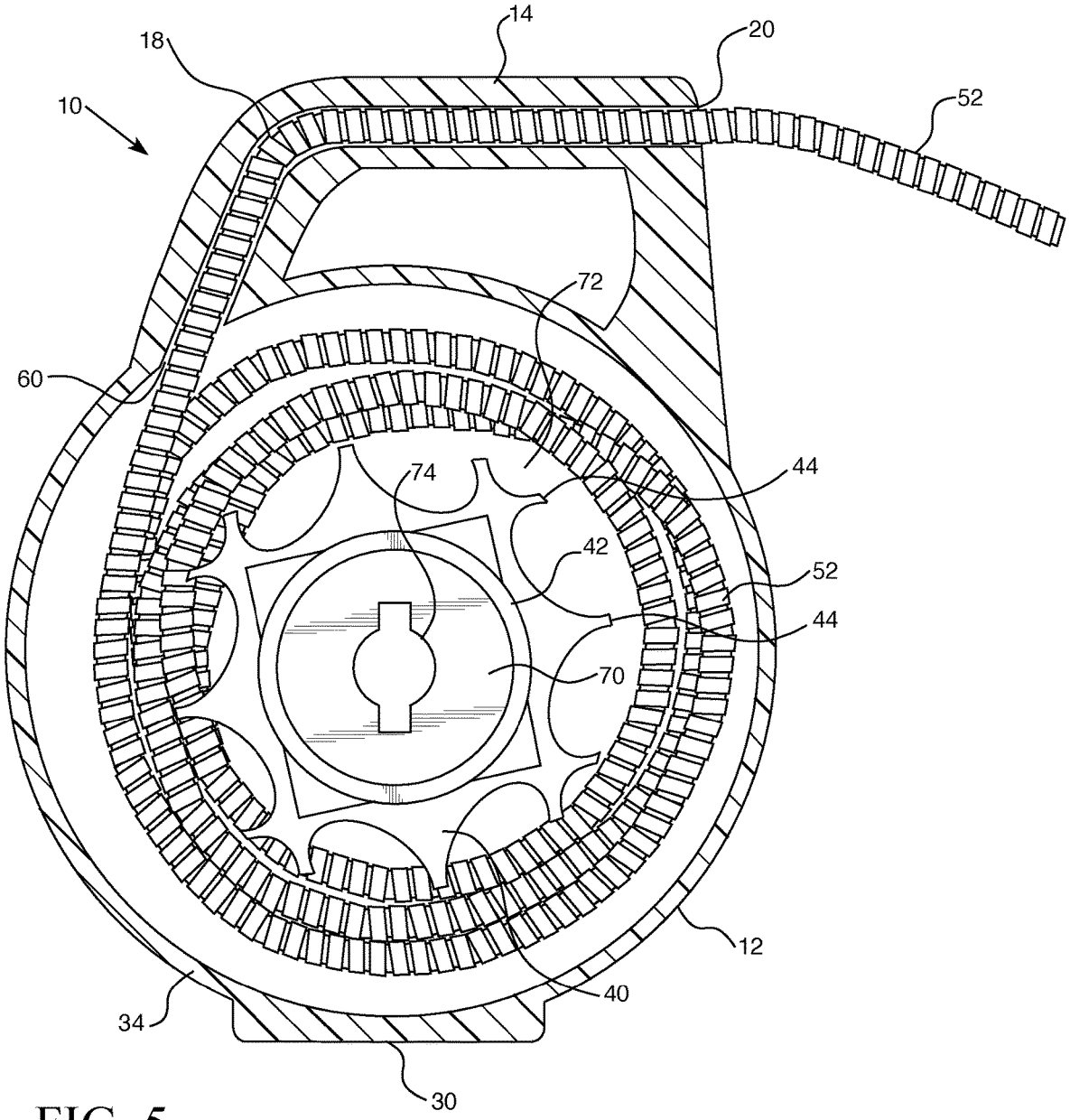
FIG. 5 depicts a cross sectional view of the flexible conduit dispensing case 10.

Referring specifically to FIG. 5 and FIG. 7, it can be clearly seen how the flexible conduit 52 is loaded into the dispenser case 10. Right side 32*b* has been removed. Now visible is chamber 72, defined by outer body 12, and the chamber 72 contains the coiled section of flexible conduit 52. At the center of chamber 72 is hub member 70, which can either be formed as part of left side 32*a* or attached to left side 32*a* after the creation of both parts. Key slot 74 receives locking member 16 to allow it to lock the two outer portions, 32*a* and 32*b*, of the outer body 12 together and with joining ring 34 positioned between 32*a* and 32*b*. Rotating hub 40, via bearing ring 42, can rotate on hub member 70. When it does, the engagement members 44 on the rotating hub 40 will engage the inner diameter of the coiled portion of the length of flexible conduit 52, and the coiled portion of the length of flexible conduit 52 will move as a single unit, preventing it from kinking, binding, or snarling.

It is preferred, but not required, that the space on the right side and the left side between the outermost width 48 of the engagement members 44 and the width of the chamber 72 be less than the diameter of the flexible conduit 52 so that the flexible conduit 52 is not able to slip into the spaces between the engagement members 44 and the opposing inner surfaces of the chamber 72 and bind, snag, or tangle. The width of the chamber 72 and the engagement members 44 is their dimensional length parallel to the axis of rotation.

To save material and/or reduce friction and/or for any other reasonable purpose, it is possible to "stagger" the width 48 of the engagement members 44 so that not all of them are less than the flexible conduit's 52 diameter away from the inner surface of chamber 72. Some engagement members 44 may exist primarily to engage the coil of flexible conduit 52, and have a clearance greater than the diameter of the flexible conduit 52 with the inner surfaces of the chamber 72. While the remaining engagement members 44 may be less than the diameter of the length of flexible conduit 52 away from both inner surfaces or only one inner surface of chamber 72.

Note that the elasticity of flexible conduit 52 can cause it to try to uncoil in chamber 72 when it is not under tension, as can be seen in the portion of the coil visible to the viewer's upper right in FIG. 5. When tension is applied as a user pulls flexible conduit 52 out through exit port 20 in handle 14, the coil will tighten until it engages the engagement members 44 of rotating hub 40, which will then cause the entire coil to rotate and prevent it from decreasing in diameter any further or assuming a spiral shape which is more likely to kink, bend, tangle, or snarl. The configuration of rotating hub 40 also reduces the chance that a portion of flexible conduit 52 will move laterally along the general axis of rotation and engage another part of the coil at an angle, which likewise reduces the chance of tangling.

Figure 8:
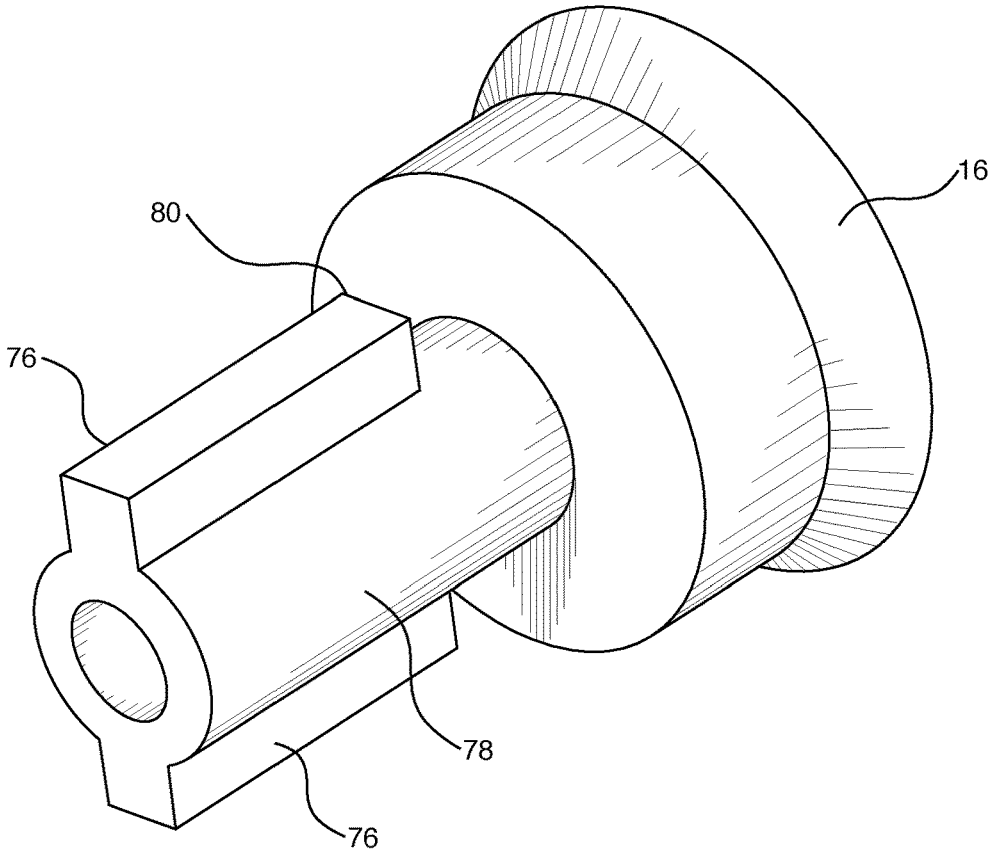
FIG. 8 depicts a left perspective view of locking member 16.
Figure 9:
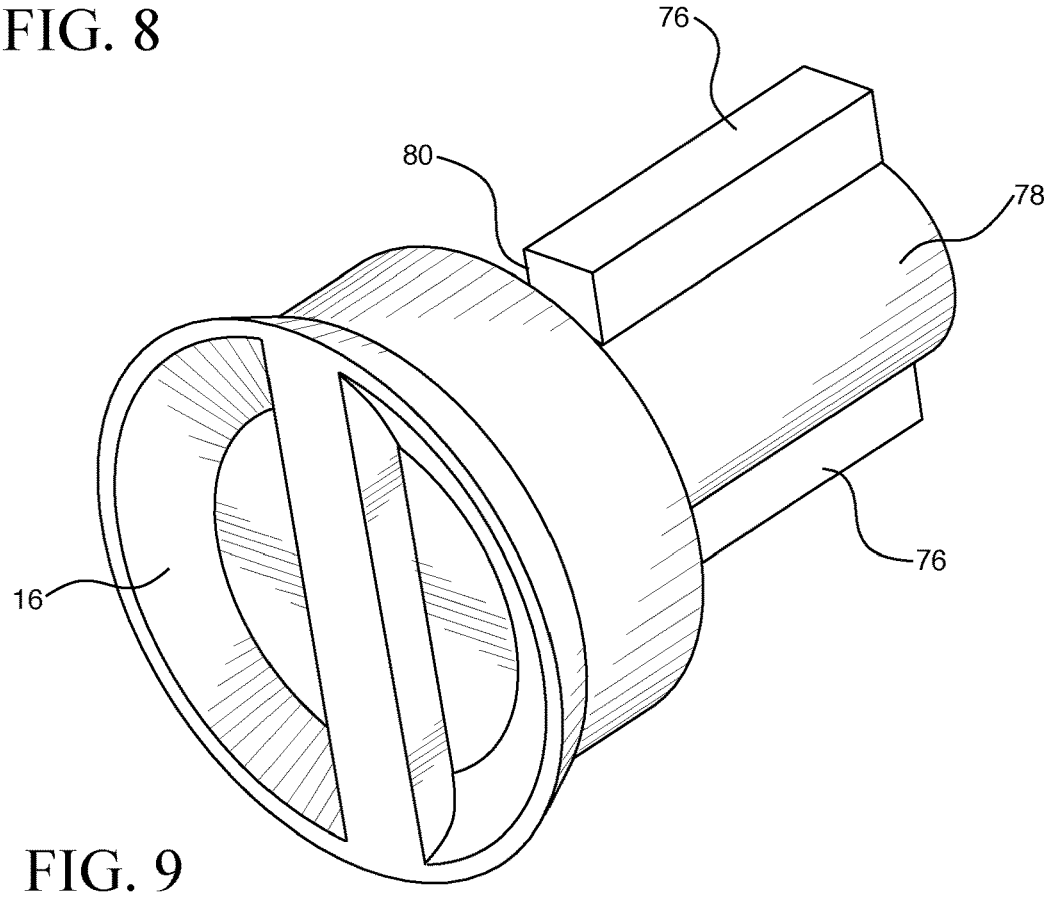
FIG. 9 depicts a right perspective view of locking member 16.
Figure 10:
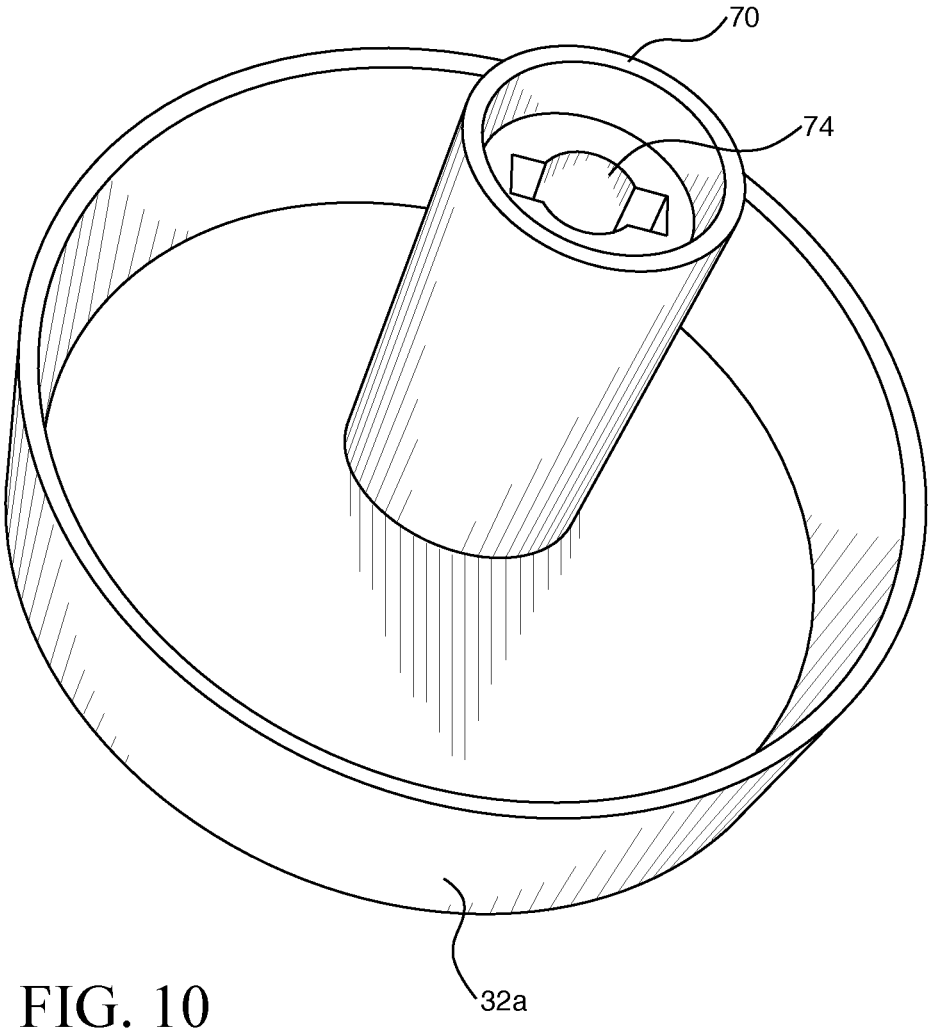
FIG. 10 depicts a right perspective view of left side 32*a* with hub member 70.

Now adding FIG. 8, FIG. 9, and FIG. 10 to the consideration, the structure and function of locking member 16 can be clearly seen. Locking member 16 has locking shaft 78 and retainer tabs 76. Locking member 16 cooperates with key slot 74 on hub member 70. Hub member 70 is a hollow shaft. Retainer tabs 76 of locking shaft 78 are aligned with the key slot 74. Locking shaft 78 is inserted until at least the proximal ends 80 are fully encompassed within the hollow shaft of hub member 70. Then, locking member is rotated to offset the retainer tabs 76 from key slot 74 to secure locking member 16 within hub member 70. When the user wants to open case 10, the user rotates locking member 16 so that the retainer tabs 76 align with key slot 74 so that locking member 16 can be removed from hub member 70.

A method of using the flexible conduit dispenser case 10 comprises the following steps:

1) A user obtains a flexible conduit dispenser case 10 and a desired quantity of flexible conduit 52;

2) The user rotates locking member 16 to open flexible conduit dispenser case 10 by removing the right side 32*b* from the left side 32*a* and the joining ring 34;

3) The user places the coil of flexible conduit 52 around rotating hub 40 and engages the coil of flexible conduit 52 with engaging members 44. The user places the coil of flexible conduit 52 so that when it is dispensed, it will allow for a clockwise rotation as viewed from the right side of the coil of flexible conduit 52;

4) The user inserts the proximal end of the coil of flexible conduit 52 through opening 60 into conduit channel 18 of handle 14 by threading the proximal end of the coil of flexible conduit 52 through a sufficient distance to allow for a sufficient length of flexible conduit 54 to emerge from exit port 20;

5) The user places right side 32*b* on joining ring 34;

6) The user rotates locking member 16 to secure the connection between left side 32*a*, right side 32*b*, and joining ring 34;

7) In an optional step, the user rests the flexible conduit case 10 on the planar base 30;

8) The user pulls flexible conduit 54 from the exit port 20 and places it as desired. When a desired length of flexible conduit 54 has been removed from flexible conduit dispenser case 10, the user cuts the length of flexible conduit 54.

Steps 1 through 8 can be performed as many times as desired. As is obvious, the direction of rotation in Step 3 will be dependent on the exact configuration of the flexible conduit dispenser case 10 and some configurations may require a counter-clockwise rotation as viewed from the right side of the coil of flexible conduit 52. Steps 7 (if used) and 8 can be performed in any desired order.

While various embodiments and aspects of the present invention have been described above, it should be understood that they have been presented by way of example only, and not limitation. Thus, the breadth and scope of the present invention should not be limited by any of the above exemplary embodiments.

This application—taken as a whole with the abstract, specification, and drawings being combined—provides sufficient information for a person having ordinary skill in the art to practice the invention as disclosed herein. Any measures necessary to practice this invention are well within the skill of a person having ordinary skill in this art after that person has made a careful study of this disclosure.

Because of this disclosure and solely because of this disclosure, modification of this device and method can become clear to a person having ordinary skill in this particular art. Such modifications are clearly covered by this disclosure.

What is claimed and sought to be protected by Letters Patent is:

1. A flexible conduit dispenser case comprising:

a) an outer body, the outer body defining an inner chamber;

b) a rotating hub, the rotating hub co-axial with the inner chamber; and c) a handle located on an exterior of the outer body, the handle having a conduit channel, the conduit channel communicating with the inner chamber such that a length of flexible conduit can be coiled around the rotating hub, enter the conduit channel, and emerge through an exit port.

2. The flexible conduit dispenser case of claim 1, further comprising:

a) a planar base, the planar base being diametrically opposed to the handle on the outer body, the planar base tangent to the outer body and at a right angle to a diameter of the outer body such that when the planar base is in contact with a floor, the handle is at an uppermost point on the outer body and the outer body is held orthogonal to the floor, and the planar base being fixed to the flexible conduit dispenser case such that it will not rotate when the length of flexible conduit is pulled through the exit port.

3. The flexible conduit dispenser case of claim 2, wherein the rotating hub has a plurality of engagement members, and the length of flexible conduit has a plurality of exterior ridges, such that some or all of the plurality of engagement members engage the plurality of exterior ridges and cause the length of flexible conduit which is coiled to rotate as a single coil at a common rotation speed.

4. The flexible conduit dispenser case of claim 3 further comprising:

a) the outer body having a right side, a left side, and a joining ring, wherein the joining ring is positioned between the right side and the left side and the handle being attached to the joining ring; and b) the joining ring having an opening, wherein the opening allows the flexible conduit to exit the inner chamber into the conduit channel in the handle.

5. The flexible conduit dispenser case of claim 4 further comprising:

a) a locking member securing the right side to the left side with the joining ring in between the right side and the left side; and b) the locking member cooperating with a hub member on the left side, wherein the hub member has a key slot and the locking member has a locking shaft with at least one retainer tab, wherein the locking shaft inserts into the hub member through the cooperation of the at least one retainer tab and the key slot and the at least one retainer tab is offset from the key slot to secure the connection and the at least one retainer tab is aligned with the key slot to release the connection.

6. The flexible conduit dispenser case of claim 3, wherein one or more of the plurality of engagement members have a clearance, the clearance being a distance between a portion of any of the one or more of the plurality of engagement members closest to an inner surface of the inner chamber and the inner surface of the inner chamber, and the clearance is less than a conduit diameter of the flexible conduit.

7. The flexible conduit dispenser case of claim 6, wherein each of the plurality of engagement members that have a clearance have either a right clearance which is the clearance between that engagement member and a right inner surface of the inner chamber, or a left clearance which is the clearance between that engagement member and a left inner surface of the inner chamber, and the right clearance or the left clearance are less than a conduit diameter of the flexible conduit.

8. The flexible conduit dispenser case of claim 6, wherein each of the plurality of engagement members that have a clearance have a right clearance which is the clearance between that engagement member and a right inner surface of the inner chamber and a left clearance which is the clearance between that engagement member and a left inner surface of the inner chamber, and the right clearance and the left clearance are less than a conduit diameter of the flexible conduit.

9. The flexible conduit dispenser case of claim 2 further comprising:

a) the outer body having a right side, a left side, and a joining ring, wherein the joining ring is positioned between the right side and the left side and the handle being attached to the joining ring; and b) the joining ring having an opening, wherein the opening allows the flexible conduit to exit the inner chamber into the conduit channel in the handle.

10. The flexible conduit dispenser case of claim 9 further comprising:

a) a locking member securing the right side to the left side with the joining ring in between the right side and the left side; and b) the locking member cooperating with a hub member on the left side, wherein the hub member has a key slot and the locking member has a locking shaft with at least one retainer tab, wherein the locking shaft inserts into the hub member through the cooperation of the at least one retainer tab and the key slot and the at least one retainer tab is offset from the key slot to secure the connection and the at least one retainer tab is aligned with the key slot to release the connection.

11. The flexible conduit dispenser case of claim 1, wherein the rotating hub has a plurality of engagement members, and the length of flexible conduit has a plurality of exterior ridges, such that some or all of the plurality of engagement members engage the plurality of exterior ridges and cause the length of flexible conduit which is coiled to rotate as a single coil at a common rotation speed.

12. The flexible conduit dispenser case of claim 11 further comprising:

a) the outer body having a right side, a left side, and a joining ring, wherein the joining ring is positioned between the right side and the left side and the handle being attached to the joining ring; and b) the joining ring having an opening, wherein the opening allows the flexible conduit to exit the inner chamber into the conduit channel in the handle.

13. The flexible conduit dispenser case of claim 12 further comprising:

a) a locking member securing the right side to the left side with the joining ring in between the right side and the left side; and b) the locking member cooperating with a hub member on the left side, wherein the hub member has a key slot and the locking member has a locking shaft with at least one retainer tab, wherein the locking shaft inserts into the hub member through the cooperation of the at least one retainer tab and the key slot and the at least one retainer tab is offset from the key slot to secure the connection and the at least one retainer tab is aligned with the key slot to release the connection.

14. The flexible conduit dispenser case of claim 11, wherein one or more of the plurality of engagement members have a clearance, the clearance being a distance between a portion of any of the one or more of the plurality of engagement members closest to an inner surface of the inner chamber and the inner surface of the inner chamber, and the clearance is less than a conduit diameter of the flexible conduit.

15. The flexible conduit dispenser case of claim 14, wherein each of the plurality of engagement members that have a clearance have either a right clearance which is the clearance between that engagement member and a right inner surface of the inner chamber, or a left clearance which is the clearance between that engagement member and a left inner surface of the inner chamber, and the right clearance or the left clearance are less than a conduit diameter of the flexible conduit.

16. The flexible conduit dispenser case of claim 14, wherein each of the plurality of engagement members that have a clearance have a right clearance which is the clearance between that engagement member and a right inner surface of the inner chamber and a left clearance which is the clearance between that engagement member and a left inner surface of the inner chamber, and the right clearance and the left clearance are less than a conduit diameter of the flexible conduit.

17. The flexible conduit dispenser case of claim 1 further comprising:

a) the outer body having a right side, a left side, and a joining ring, wherein the joining ring is positioned between the right side and the left side and the handle being attached to the joining ring; and b) the joining ring having an opening, wherein the opening allows the flexible conduit to exit the inner chamber into the conduit channel in the handle.

18. The flexible conduit dispenser case of claim 17 further comprising:

a) a locking member securing the right side to the left side with the joining ring in between the right side and the left side; and b) the locking member cooperating with a hub member on the left side, wherein the hub member has a key slot and the locking member has a locking shaft with at least one retainer tab, wherein the locking shaft inserts into the hub member through the cooperation of the at least one retainer tab and the key slot and the at least one retainer tab is offset from the key slot to secure the connection and the at least one retainer tab is aligned with the key slot to release the connection.

* * * * *